United States Patent [19]

Schuegraf

[11] 4,231,000

[45] Oct. 28, 1980

[54] ANTENNA FEED SYSTEM FOR DOUBLE POLARIZATION

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 895,122

[22] Filed: Apr. 10, 1978

[30] Foreign Application Priority Data

Apr. 29, 1977 [DE] Fed. Rep. of Germany ..... 2719283

[51] Int. Cl.[2] ..... H01P 5/18; H01P 5/12

[52] U.S. Cl. ..... 333/109; 333/110; 333/134; 343/858

[58] Field of Search ..... 343/100 ST, 786, 858; 333/109, 110, 134, 21 A, 21 R

[56] References Cited

U.S. PATENT DOCUMENTS

| | | | |
|---|---|---|---|
| 3,827,051 | 7/1974 | Foldes | 343/854 |
| 4,047,128 | 9/1977 | Morz | 343/786 |

OTHER PUBLICATIONS

Kreutel; Proc. of Intelsat 5 Earth-Station Tech. Seminar, Munich, Jul. 13-18, 1976 pp. K-29-K30 & Fig. K-15.

Meinke & Gundlach; Taschenbuch der Hochfrequenztechnik, Springer-Verlag; Berlin; 1962, p. 433 & Fig. 16.4.

*Primary Examiner*—Eli Lieberman

*Attorney, Agent, or Firm*—Hill, Van Santen, Steadman, Chiara & Simpson

[57] ABSTRACT

Antenna system for double polarization in two high frequency bands of different frequency positions includes a orthomode transducer, in the following text called polarization filter having an antenna end terminal and two directional terminals, one being for right circular polarized waves, and the other being for left circular polarized waves. These directional terminals connect, respectively, with two frequency filters which separate the signals into the lower of the two high frequency bands, and the higher of the two high frequency bands. There are two 3-dB 90° directional couplers, one of which handles right and left circular polarized signals of the lower frequency band, and the other of which handles right and left circular polarized signals of the higher frequency band. The polarization filter is constructed to be phase-symmetrical with respect to its transit paths. The directional terminals of the polarization filter are connected directly to the frequency filters, respectively, or through two structurally symmetrical 45° twisted components of different twisting directions. The connection lines between the frequency filters and the directional couplers in each case for the two frequency bands occupy dual polarization directions of the same frequency range. These are phase-symmetrical pairs of lines with connection elements which match one another in pairs at the same point of the line.

20 Claims, 7 Drawing Figures

Fig. 5
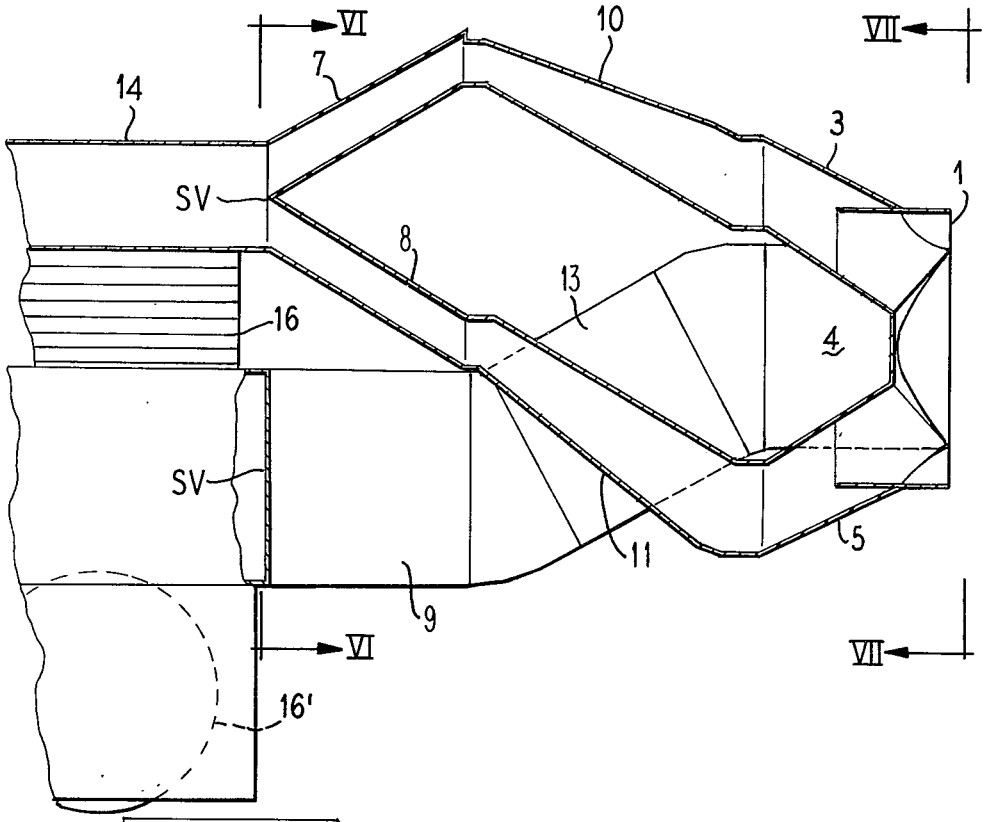
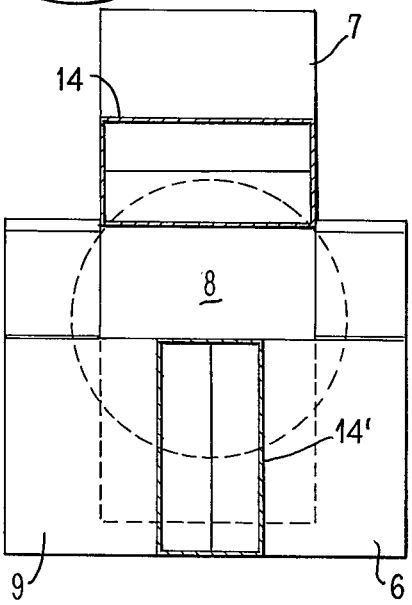
Fig. 6
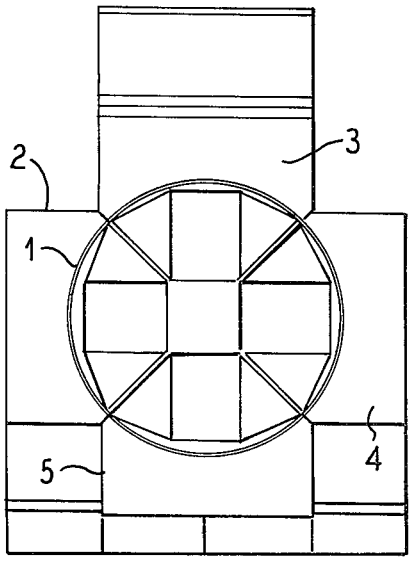
Fig. 7

ANTENNA FEED SYSTEM FOR DOUBLE POLARIZATION

BACKGROUND OF THE INVENTION

The invention relates to an antenna feed system for double polarization in two high-frequency bands of differing frequency position, consisting of a polarization dividing filter having an antenna-end terminal which is common to the two frequency bands and having two directional antennae which are each assigned to one polarization direction in each case for a frequency dividing filter whose terminal which is common to the two frequency bands is in each case connected to one of the directional antennae of the polarization dividing filter, further consisting of a first 3-dB-directional coupler for the lower frequency band, whose double access is connected to a further terminal, assigned to the lower frequency band, of the two frequency filters, and further consisting of a 3-dB-directional coupler for the upper frequency band which is connected to a further terminal, assigned to the upper frequency band, of the frequency filters.

An antenna feed system of this type is known, for example, from the publication "Proceedings of Intelsat 5 Earth-Station Technology Seminar" in Munich of the 13th to 18th June, 1976, in particular FIG. K-15. FIG. 1 is a block circuit diagram of an antenna feed system of this type for circular double polarization in two frequency ranges. The fundamental aim of such an arrangement consists in converting two transmitting bands of like frequency position, for example, from 5.925 GHz to 6.425 GHz and with powers of up to approximately 10 KW into a transmitting band of right-circular wave form and a further transmitting band of left-circular wave form, and thus to provide that the latter, again decoupled from one another, are combined in a common main waveguide which also conducts two like-frequency receiving bands with a frequency position which is displaced relative to the transmitting bands, for example from 3.7 GHz to 4.2 GHz in right-circular and left-circular polarized wave form, thus decoupled from one another. These receiving bands are also separated in respect of their right-circular and left-circular polarization and, having been converted into the $H_{01}$ wave form, must be fed to two receiving waveguides.

These functions are fulfilled by the circuit illustrated in FIG. 1 in the following manner. For example, a 6 GHz band is split by means of a 3-dB-directional coupler into two half waves with +90° and −90° phase difference. The sign of the 90°-phase is dependent only upon which of the two arms of the 3-dB-coupler at which feed-in takes place. These half waves are fed via two identical frequency filters to a polarization filter in such a manner that they are at right angles to one another at the latter's output. If the condition is fulfilled that the two half waves travel their path to the polarization filter output without mutual phase distortion, at said output they still possess a mutual time phase of ±90° and thus represent a purely circularly polarized wave.

The aim of the circuit illustrated in FIG. 1 is, employing one and the same antenna, to radiate two like-frequency transmitting bands right-hand circularly and left-hand circularly, thus decoupled from one another, and to feed two right-hand circular and left-hand circular waves received by this antenna in a different frequency band to separate receiving amplifiers in accordance with their polarization direction.

The difficulties which occur in the realization of the concept illustrated in FIG. 1 mainly consist in designing the two transit paths, each provided for one frequency band, of the overall arrangement to be symmetrical in construction or at least symmetrical in phase. Furthermore, it is to be endeavored to provide the best possible transmission properties in respect to attenuation, reflection and decoupling for the four transit paths of the circuit illustrated in FIG. 1.

BRIEF SUMMARY OF THE INVENTION

Therefore, the aim of the present invention is, for an antenna feed system of the type described above, to provide a realization, in respect of apparatus, which is characterized on the one hand by compactness of mechanical construction, and on the other hand, by good transmission properties and phase symmetry for all the transit paths of the same frequency.

Commencing from an antenna feed system for double polarization in two high-frequency bands of different frequency position, consisting of a polarization filter having an antenna-end terminal which is common to the two frequency bands and two directional terminals, each assigned to one polarization direction, each for a frequency filter whose terminal which is common to the two frequency bands, is in each case connected to one of the directional antennae of the polarization filter. A first 3-dB-directional coupler for the lower frequency band whose double case is in each case connected to a further terminal, is assigned to the lower frequency band, of the two frequency filters, and further consisting of a 3-dB-directional coupler for the upper frequency band which is in each case connected to a further terminal, assigned to the upper frequency band, of the frequency filters. This aim is realized in accordance with the invention in that the polarization filter is constructed to be phase symmetrical in respect to its transit paths. The directional terminals of the polarization filter are connected to the frequency filters via two 45° stranded components which possess different directions of stranding and are precisely symmetrical with respect to construction. The connection lines between the frequency filters and the 3-dB-directional couplers for two frequency bands occupying dual polarization directions of the same frequency range are constructed as phase-symmetrical line pairs with connection elements which match one another in pairs at the same location of the line.

BRIEF DESCRIPTION OF THE DRAWINGS

FIG. 5 is a partial sectional view taken along the line V—V of FIG. 4;

FIG. 6 is a sectional view taken along the line VI—VI of FIG. 5; and

FIG. 7 is a view of the structure looking at it in the manner shown by the line VII—VII of FIG. 5.

DESCRIPTION OF THE PREFERRED EMBODIMENTS

Figure 2:
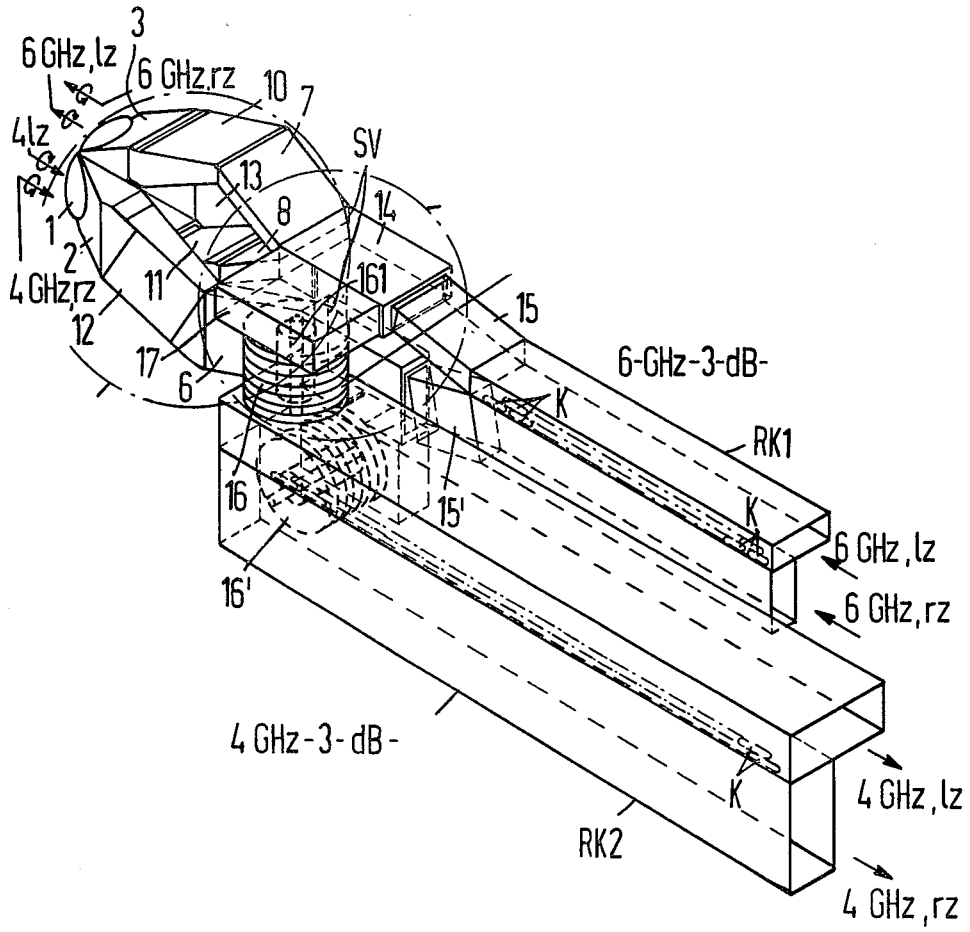
FIG. 2 illustrates a preferred embodiment in accordance with the invention of an antenna feed system corresponding to FIG. 1.

In order to illustrate the construction of the preferred embodiment shown in FIG. 2, the wide-band polarization filter PW shown in the left-hand part of FIG. 2 will first be considered. A phase-symmetrical polarization filter of this type, already disclosed in an earlier proposal, contains a first arm 1 which lies in the longitudinal axis of the arrangement and in the exemplary embodiment is of cylindrical design and is provided for connecting an ongoing waveguide of round or square cross-section, and four sub-arms 2 to 5 which are of identical design and are arranged rotated relative to one another by 90°, and each run at the same angle relative to the longitudinal axis of the arrangement in the opposite direction to the first arm. In the exemplary embodiment, these sub-arms of the double branching each have a rectangular cross-section and those pairs of rectangular waveguides which lie opposite one another are of fully symmetrical construction. In this polarization filter, two sub-arms of the double branching which lie opposite one another are connected in pairs via filter arm sections, which will be explained in detail in the following, to the sub-arms 6 to 9 of a series branching SV. A series branching SV of this type consists of two rectangular waveguides which originally rested one upon another on their wide side and which are symmetrically bent away from one another at the point at which the partition plate commences. The four sub-arms of the polarization filter are connected in pairs, i.e., the sub-arms which in each case lie opposite one another are connected to the sub-arms 6 to 9 of the series branchings via filter arm sections designed as E-displacement components 10, 11 on the one hand, and further filter arm sections designed as H-displacement components 12, 13, on the other hand. The E-displacement components 10, 11 which are illustrated one above another in FIG. 2 each consist of a rectangular waveguide component provided on both sides with a waveguide elbow and which is bent by the waveguide elbow on both sides in opposite directions along the wide side. The two E-displacement componets run approximately in parallel with one another and are commonly aligned obliquely to the longitudinal axis of the arrangement so that their end cross-sections which face towards the sub-arms of the series branchings are no longer symmetrical to the longitudinal axis of the arrangement but are displaced by a specific distance relative to the longitudinal axis. The filter arm sections provided in the other transit path of the polarization filter are designed as H-displacement components 12, 13 and each consist of a rectangular waveguide component which is provided on both sides with a waveguide elbow and is bent by the waveguide elbows on both sides in opposite directions along the narrow side. Now the two rectangular, access cross-sections of the double branching which lie one above another are displaced upwards to such an extent that the cross-sections of the horizontal pair of waveguides are displaced downwards to such an extent that the displaced cross-sections can be combined in pairs with two identical series branchings which do not mutually penetrate one another. In the above described polarization filter, the two transit paths are designed to be phase-symmetrical so that they enjoy a wide-band phase synchronism. Furthermore, the flange surfaces lying between the series branchings SV and the rectangular waveguide accesses are arranged in the same plane. A polarization filter of this kind having two rectangular waveguide accesses with parallel axes and terminal flange surfaces lying in one plane have a structural length of approximately 155 mm for a 4/6-GHz design.

Figure 4:
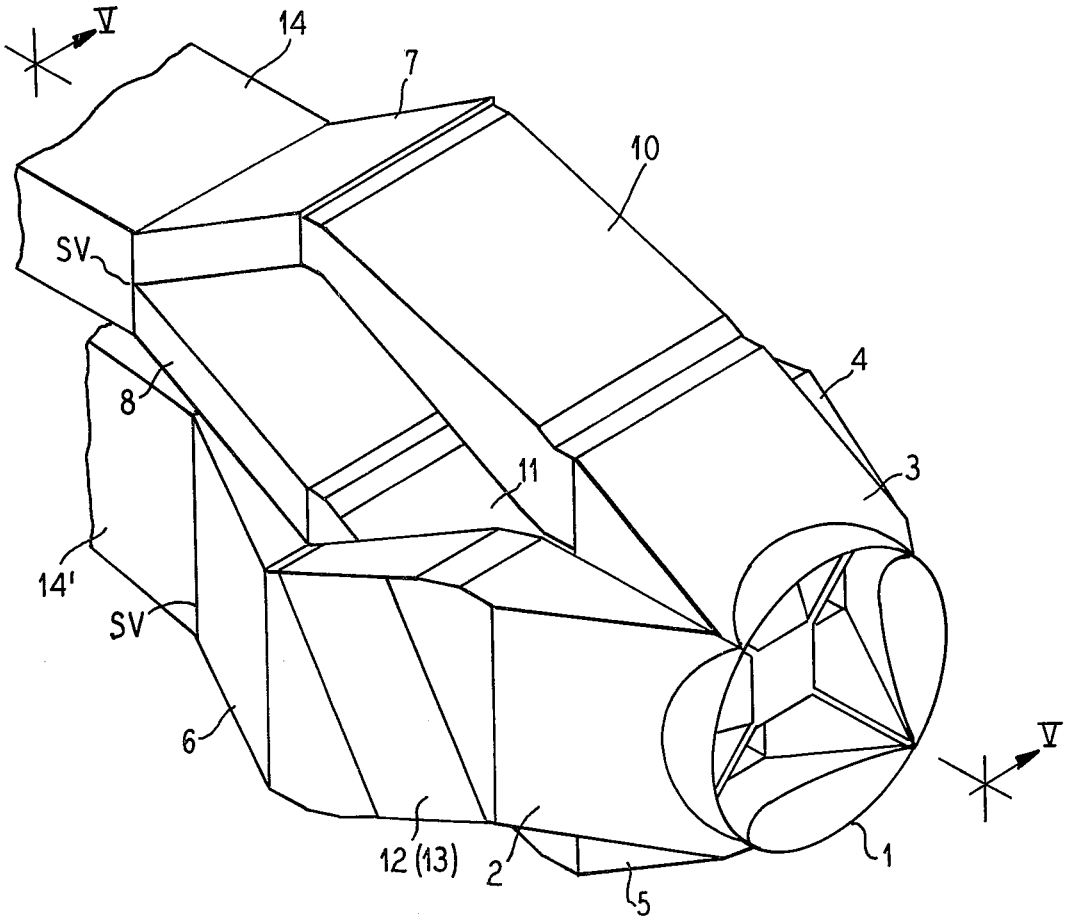
FIG. 4 is an enlarged isometric view of the phase symmetrical polarization filter.

As can be seen from FIG. 2, in the construction in accordance with the invention, the two filter flanges SV (see FIGS. 2, 4 and 5) are connected without any connection line to a 4/6 GHz frequency filter FW as likewise described in an earlier proposal. A frequency filter FW of this kind consists of two waveguide sections 14 (see FIG. 4), 15 of diffeent cross-section and the lower frequency band is output coupled via the extended inner conductor of a radial band stop filter 16, on the waveguide section which is common to the two frequency bands and, as illustrated in FIG. 2, for high transit power on a third waveguide 17 which is coupled to the common waveguide section 14. In the 4/6 HGz design, this frequency filter FW has a structural length of approximately 75 mm and is provided with a straight 6-GHz-transit and its 6 GHz radial circuit block 16 which is coupled via the lateral 4 GHz resonator 17 in order to provide a possibility of direct connection to the following pairs of waveguides, aligned in parallel with the main axis of the arrangement, of the 6- and the 4-GHz 3-dB-directional coupler RK1 and RK2, respectively.

A connection, as described above, of a phase-symmetrical polarization filter to two frequency filters identical to one another, represents a phase-symmetrical system filter, for example, for radio relay in the 4- and 6-GHz frequency range, it being possible to operate one and the same antenna with two linear polarizations decoupled from one another in these two ranges. For use in satellite broadcasting, an arrangement of this kind can also be referred to as an antenna feed system for linear double polarization in a transmitting- and receiving-frequency range.

Figure 1:
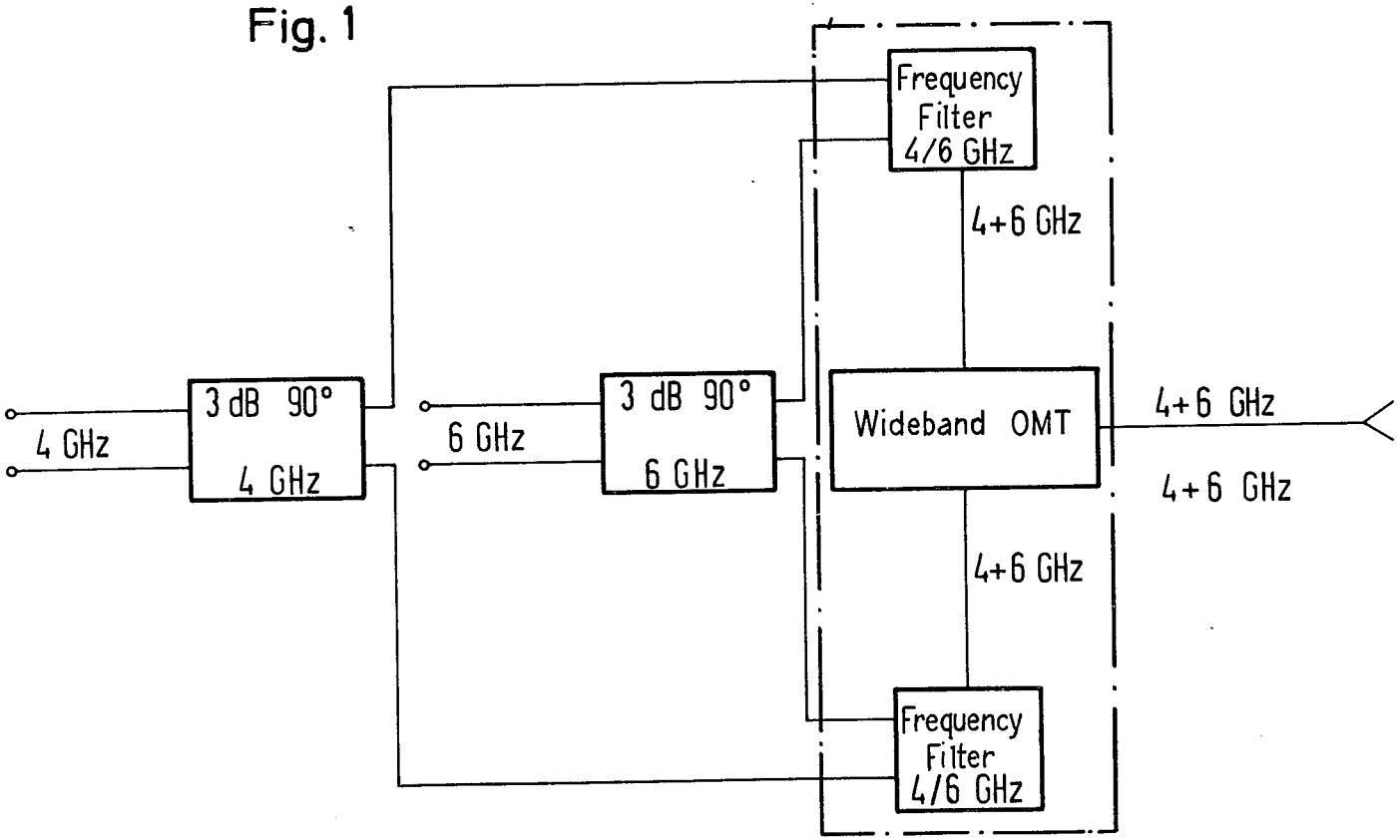
FIG. 1 illustrates a block circuit diagram, which has already been explained hereinabove, of an antenna feed system for circular double polarization in two frequency ranges.

In accordance with the fundamental circuit diagram shown in FIG. 1, a phase-symmetrical system filter of this kind can be extended by an optimized 3-dB-coupler in each case in the transmitting band and in the receiving band to form an antenna feed system for circular double polarization in these two frequency ranges.

An essential requirement is to establish the shortest possible connections from the two coaxial 4-GHz accesses of the frequency filter FW and from its rectangular 6-GHz accesses to the 4- and 6-GHz-3-dB-coupler RK2 and RK1, respectively. In order to avoid phase distortions in the two 4- and 6-GHz branch lines, these connection lines must also be absolutely phase-symmetrical, i.e., must be electrically equal in length under all operating frequencies. A phase-symmetrical, double connection of this kind can be achieved by a structurally symmetrical design of the line pairs, and for this purpose the one line branch should be constructed as far as possible with the same connection elements as the other, and these elements should be employed at identical points of the line. In the exemplary embodiment illustrated in FIG. 2, a structurally symmetrical connection between the two 4 GHz coaxial accesses of the frequency filters and the pair of waveguides of the 4 GHz-3db-coupler to two coaxial waveguide junctions which are identical to one another, is achieved if, as can be seen from FIG. 2, the waveguide cross-sections of the 4 GHz-3dB-coupler are arranged in L-shape, i.e., if the 3-dB-directional coupler RK2 is designed as a pair of rectangular waveguides arranged in L-shape in respect of the cross-sectional surfaces, and aligned in parallel to the longitudinal axis of the overall arrangement, in such a way that the narrow side of the one waveguide is positioned on the wide side of the other waveguide or possesses a common wall with a part of this wide side. Then coupling openings K in this common wall serve to couple the magnetic longitudinal fields of the two waveguides to one another.

A corresponding, further L-coupler aligned in parallel with the longitudinal axis of the arrangement, as illustrated in the lower part of FIG. 2 for the 4-GHz range, is also connected to the rectangular 6-GHz-accesses of the frequency filters. As the cross-sections SV of these two accesses to the frequency filters lie in the same plane and are also at right angles to one another, although they possess a certain distance from one another which is inevitably topologically governed by the construction of the polarization filter, and which is also advantageous for the structurally symmetrical transition to the 4-GHz-3db-coupler RK2, as can be seen from FIG. 2, an oblique waveguide section 15, 15' having a maximum length of $\lambda_H$ is used for connection to the 6-GHz-3-dB-coupler RK1.

The angles of bend of this 6-GHz double link at which, in both cases or at least in one case, a bend is made simultaneously along the narrow and the wide side of the waveguide, can be maintained sufficiently small to ensure that a phase-symmetrical double transition from the frequency filters to the 6-GHz-3db-coupler RK1 can be easily achieved, in particular since the E-waveguide bend and the H-waveguide bend have a virtually identical phase response with the same angle of bend.

In the case of the "L-coupler" as shown in FIG. 2, the coupling is carried out similarly to the coupler described for example, in the "Taschenbuch der Hochfrequenztechnik" by Meinke and Gundlach, 2nd Edition, page 433, wherein the rectangular waveguide cross-sections are arranged in T-shape, via the magnetic longitudinal component $H_z$, wherein the L-coupler has the advantage that the coupling openings K in accordance with the illustration in FIG. 2, are arranged in the two waveguides in the region of the maximum $H_z$ components, namely on the narrow waveguide side of the one waveguide and thus simultaneously in the edge region of the wide waveguide side of the other waveguide. This provides the advantage that in the L-coupler a smaller number of coupling openings is sufficient for a specific coupling attenuation, so that the L-coupler has a shorter structural length than a corresponding T-coupler.

In order to achieve a stronger coupling per length unit it is expedient to employ the measure, illustrated in FIG. 2, of employing two or a plurality of rows of holes arranged directly beside one another. To ensure that the coupling openings do not lie too far from the position of the maximum coupling field strength on the narrow waveguide wide side, in the exemplary embodiment shown in FIG. 2, the conventional round coupling holes have not been provided, but longitudinal holes which are displaced relative to one another by approximately half the length of one hole in the longitudinal direction in two rows directly beside one another. It is also advantageous that the coupling strength of a longitudinal hole having a length L which is equal to that of a round coupling hole having a diameter D=L. Since in the exemplary embodiment shown in FIG. 2, the two rows of holes lie very close to the narrow waveguide side with a maximum $H_z$, which furthermore is distributed in cosine fashion over the waveguide wide side, the two rows of holes make an approximately equal contribution to the coupling. It should be noted that, in order to achieve a high directional attenuation, the hole spacing in a row of holes must amount to approximately $\lambda_H/4$.

In the dimensioning of the coupling openings in the L- and in the T-coupler, it should be ensured that the coupling takes place only via the $H_z$-component on both sides of the coupling opening, and that due to the reduction in the $H_z$-component with increasing frequency and constant power by the factor $$\lambda_o/\sqrt[4]{1-\left(\frac{\lambda_o}{\lambda_k}\right)^2}$$

the strength of the coupling also decreases with increasing frequency. Thus, an increasing coupling attenuation can be measured with an increasing frequency provided the diameters of the coupling openings are smaller than approximately $\lambda_H/6$. On the other hand, a measurement indicates that even with holes lengths of between $\lambda_H/6$ and $\lambda_H/4$ in the upper frequency range the coupling strength increases again and the coupling attenuation drops correspondingly. This can be explained by the fact that with a hole of increasing length, the $\lambda/2$ resonance frequency of a coupling hole approaches the operating frequency range from above and thus the lower flank of this $\lambda/2$ resonance results, in the upper part of the operating frequency range, in a drop in the coupling attenuation which increases in proportion with the frequency. Since, on the other hand, in the lower part of the frequency range, the drop in the coupling attenuation caused by the $H_z$ rise prevailing at that point is maintained, a coupling attenuation maximum occurs in the middle frequency range. Here the measured coupling attenuation is virtually constant within a wide subfrequency range. For this reason, a T-coupler, and thus also the allied L-coupler, is at least equivalent to a conventional wide-wall coupler. A particular advantage of the L-coupler consists in the particularly non-critical dimensioning of the hole spacing from the wall and the resultant increased production tolerance range which is due to the fact that the coupling is carried out in the cosine-shaped $H_z$ maximum.

In the case of the construction shown in FIG. 2, in which the components are lined up in the axial direction with very short connection lines, a 4/6-GHz-design in which the polarization filter has a structural length of 155 mm, acquires an overall structural length of only approximately 580 mm and, furthermore, a particularly short extent in the radial direction.

Figure 3:
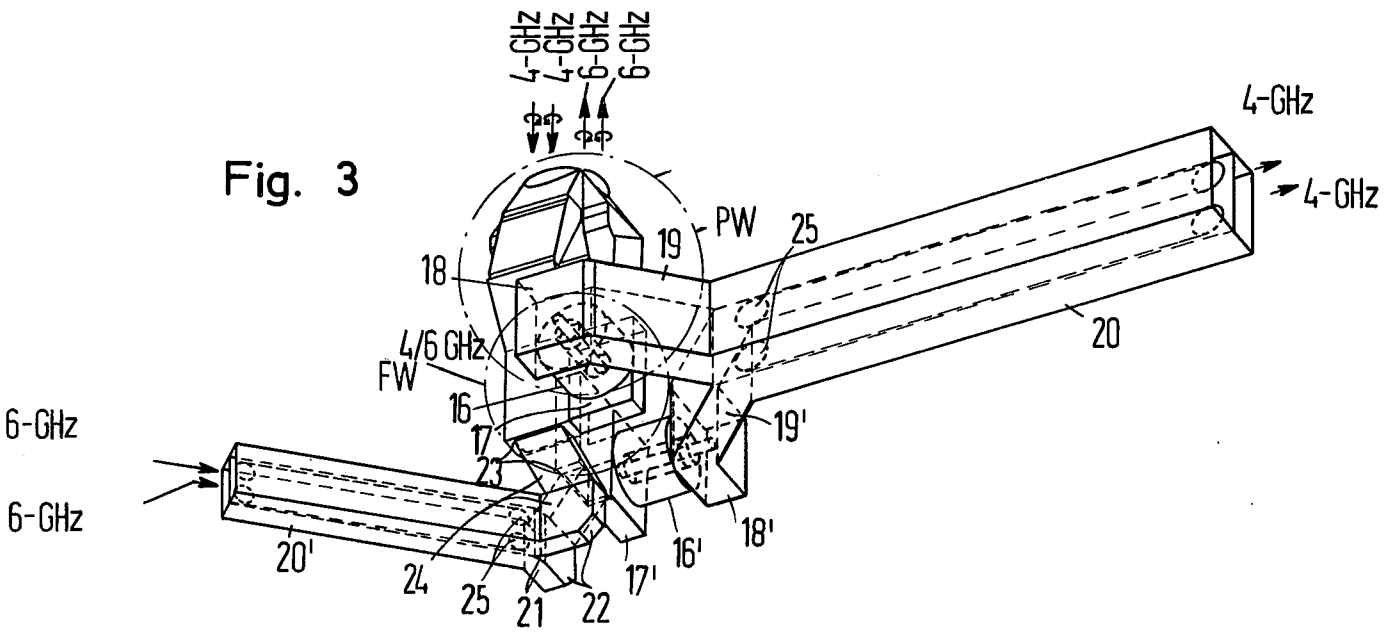
FIG. 3 illustrates a further antenna feed system in accordance with the invention.

Based on a mode of functioning which is identical to that in FIG. 2, the exemplary embodiment in FIG. 3 illustrates a further design of the antenna feed system in accordance with the invention, considered from below. Providing the arrangement with a perpendicular longitudinal axis, the upper part of the Figure illustrates the same system filter as in the exemplary embodiment shown in FIG. 2, as a combination of a phase-symmetrical polarization filter PW with two identical frequency filters FW. A difference, which is of no electrical significance, consists simply in that in the exemplary embodiment shown in FIG. 3, the front radial circuit block 16 is not, as in the exemplary embodiment shown in FIG.

2, directly facing the other radial circuit block 16' whose axis points from left to right in the horizontal direction, but is arranged on the opposite wide side of the frequency filter resonator 17' in comparison to the exemplary embodiment in FIG. 2. In the exemplary embodiment in FIG. 3, the two 4-GHz coaxial accesses of the frequency filters open directly into two coaxial waveguide junctions which are identical to one another. The waveguide section, leading from left to right, of the front coaxial waveguide junction is such that it firstly terminates at the intersection point of its longitudinal axis with the axis of the corresponding, second waveguide section 18' which runs obliquely towards the front. Then this second waveguide section 18' has the same length as the corresponding, front waveguide section 18. Thereafter, the front waveguide section 18 is bent backwards in the form of a flattened E-bend by an easily compensatible angle, for example, of 45° on its wide side, whereas the corresponding, other waveguide section 18' which runs forward is bent to the right with the same E-bend. In spite of the different directions of bend of the two E-bends in the two branches of the line, these are precisely symmetrical to one another in respect of construction. It should merely be ensured that the $E_{11}$ interference fields of the probe coupling and of the adjacent E-bend are adequately decoupled from one another by an aperiodically attenuating intermediate line.

In order to avoid a situation where the front radial circuit block 16 is penetrated by the backwards bent waveguide 19, it is necessary to extend this radial circuit block by a specific coaxial line section which can also be employed, for example, as a plug connection. A further measure in order to avoid penetration of this kind consists in positioning the front radial circuit block 16 not precisely in the center of the waveguide wide side of the frequency filter resonator, but somewhat displaced towards the left. In order to ensure complete symmetry, the other radial circuit block 16' must then be displaced towards the front by the same small quantity.

Thereafter the two lines 19 and 19' run symmetrically towards one another at double the angle of the individual E-bend, in the exemplary embodiment illustrated in FIG. 3 at 90°, obliquely frontwards and obliquely backwards until the inner waveguide wide sides meet the angle bisector between the two lines. With the aid of two E-bends, again compensated by slight flattening, of opposing direction over the wide sides of the waveguide, the two 4-GHz connections 19, 19' are led into the double waveguide of a 4-GHz wide wall coupler 20 which is formed by a rectangular pair of waveguides lying one upon another at their wide sides, and the longitudinal axis of which is aligned at right angles to the axis of the overall arrangement. The length of the waveguide double connection which is designed to be fork-shaped and entirely symmetrical in construction amounts, in the exemplary embodiment, between the radial circuit blocks and the 3-dB-coupler, to approximately one waveguide wave length $\lambda_H$.

The second double connection in the structure shown in FIG. 3 leading from the 6-GHz-accesses of the frequency filters to a 6-GHz-3 dB-coupler 20' is designed as follows. The double waveguide of the 6-GHz wide-wall coupler 20', which is constructed in the same way as the 4-GHz wide-wall coupler 20 and is likewise aligned with its longitudinal axis at right angles to the main axis of the arrangement is connected to two compensated 45° E-bends 21 which are identical to one another, thus waveguide sections bent at the wide sides of the individual waveguides. For both arms there then follow two identical, compensated 90° H-bends 22 which are executed over the waveguide narrow sides and whose starting axes are aligned vertically upwards. Their starting cross-sections thus lie in a horizontal plane at right angles to one another and possess a symmetrical position to the angle bisector which is parallel to the coupling axis. However, this position does not yet conform with the position of the 6-GHz accesses 23 of the frequency filters, which, due to the above described construction of the polarization filter, are arranged in a T-shape relative to one another. The parallel displacement of the cross-sections necessary for bridging purposes has been achieved in the exemplary embodiment with an oblique waveguide section 24. These oblique waveguide sections are of equal length to one another and can commence directly following the frequency filter as phase- and reflection-compensated E-H double bend. In the above described construction, the overall 6-GHz double line has a length which is approximately equal to the length of one waveguide wave $\lambda_H$ from the frequency filters to the 3-dB-coupler.

The coupling of the wide-wall couplers shown in the exemplary embodiment in FIG. 3, is carried out via two rows of holes which run in parallel with the edges of the common wall, with round individual openings 25. The arrangement illustrated in FIG. 3 is characterized by a particularly short structural length of approximately 330 mm in the 4/6 GHz design. On the other hand, in the radial direction, the extent is approximately 660 mm along the horizontal. This radial dimension can advantageously fulfill a distributor function in respect of supplying two transmitter racks and two receiving amplifiers, and is frequently necessary in order to spare further connection waveguides.

The aim of a further development of the invention is to employ a coaxial 3-dB-coupler on the 4-GHz side instead of the waveguide coupler illustrated in the exemplary embodiment shown in FIG. 3, and to establish the structurally symmetrical connection to the coaxial 4-GHz accesses of the radio circuit blocks with the aid of coaxial line elements. A fundamental reduction in the corresponding structural length is achieved by the use of short-slot couplers (one-hole couplers) in the two frequency ranges.

In a further development of the invention, the 6-GHz frequency filter accesses are each connected to a 45° twisted component. Both twisted components are then to be of identical construction, with the exception of the opposing direction of rotation. Then the two waveguide cross-sections at the rear of the twisted components are parallel to one another and laterally displaced from one another by a specific distance. A double waveguide which matches the wide-wall coupler here contains two double-bent, oblique waveguide sections which, apart from the directions of bend, are identical to one another and therefore structurally symmetrical. If the 6-GHz-coupler is connected here, when the remainder of the arrangement occupies the position shown in FIG. 3, it hangs vertically downwards. The length of this double line amounts to approximately $\lambda_H$.

The 6-GHz-coupler can also be pivoted out of a vertical position with a H-double bend into the horizontal plane. The length of a double-bent double line of this type amounts to approximately 1.5 $\lambda_H$.

It should be noted that by interchanging the two 45° twisted components it is also possible to interchange the accesses for the right-hand and left-hand circular polarization on the 6-GHz-3-dB-coupler, in which case the coupler, in a vertical position, rotates 90° about its longitudinal axis and, in a horizontal position, is rotated 90° in the horizontal plane.

A further development of the construction in accordance with the invention combines the 4-GHz part of the arrangement illustrated in FIG. 3, in which the waveguide coupler can be replaced by a coaxial coupler, with the 6-GHz part of the design of FIG. 2.

It will be apparent to those skilled in the art that many modifications and variations may be effected without departing from the spirit and scope of the novel concepts of the present invention.

I claim as my invention:

1. Antenna feed system for double polarization in two high-frequency bands of different frequency position, consisting of a polarization shunt with a connecting flange in common on the antenna side for both frequency bands and two directional connections respectively allocated to one polarization direction for a respective frequency shunt whose connection in common for said two frequency bands is respectively connected to one of said directional connections of said polarization shunt, consisting of a first three decibel directional coupler for the lower frequency band whose double axis is respectively connected to one further connection of both frequency shunts allocated to the lower frequency band, and consisting of a three decibel directional coupler for said upper frequency band which is respectively connected to one further connection of the frequency shunts allocated to said upper frequency band, characterized in that the polarization shunt is constructed phase-symmetrical with respect to its pass-through paths, in that the directional connections of said polarization shunt are connected directly to the frequency shunts or respectively are connected via two 45° twisted pieces of different twisting direction which are precisely constructionally symmetrical, and in that the connecting lines between said frequency shunts and said three decibel directional couplers for respectively two frequency bands of the same frequency ranges, said frequency bands existing in dual polarization directions, are constructed at the respectively same line location as phase-symmetrical line pairs with connection elements which coincide by pairs.

2. Antenna feed system as claimed in claim 1, in which said connection lines between said frequency filters and said 3-dB directional couplers for in each case two frequency bands, occupying dual polarization directions, of the same frequency range are structurally symmetrical line pairs.

3. Antenna feed system as claimed in claims 1 or 2, in which said polarization shunt is a symmetrically constructed, five-arm branching which contains a first arm which lies in the longitudinal axis of the arrangement and is provided for the connection of an ongoing waveguide of round or square cross-section, and four sub-arms which are of similar design and of rectangular cross-section with a side ratio of at least approximately 1:2, which are arranged rotated by 90° relative to one another and run at the same angle relative to the longitudinal axis of the arrangement and in the opposite direction to the first arm, and of which two of said sub-arms, lying opposite one another are connected via arm sections which are identical to one another to the sub-arms of one of two series branchings of similar design, two arm sections lying between opposite sub-arms of said double branching and the sub-arms of said series branchings being designed on the one hand as E-displacement components and on the other hand as H-displacement components, said E-displacement components being each designed as straight rectangular waveguide components provided on both sides with a waveguide elbow and bent on both sides by the waveguide elbows in opposite directions along the waveguide wide side, the two E-displacement components, with their straight sections, being aligned obliquely with respect to their narrow sides to the longitudinal axis of the arrangement and run in parallel with one another, the H-displacement components each being designed as straight rectangular waveguide components provided on both sides with a waveguide elbow and bent by the waveguide elbows on both sides in opposite directions along the waveguide narrow side, and one of said E-displacement components being accommodated between the H-displacement components in such a manner that the course of the series branchings connected to said E-displacement components and said H-displacement components being penetration-free with respect to their sub-arms.

4. Antenna feed system as claimed in claim 2, in which said frequency filters each consist of a first waveguide section in which both frequency bands exist, a second waveguide section which adjoins said first waveguide section and in which only said upper frequency band exists, said two waveguide sections being designed as rectangular waveguides of differing cross-sectional dimensions, a radial circuit block having an extended inner conductor which blocks the upper frequency band is provided as output-coupling device, and the extended inner conductor leading through an opening in the wall of said first waveguide section at a distance of approximately $\lambda_H/4$ from the effective short-circuit plane of the cross-sectional jump occurring between said waveguide sections, where $\lambda_H$ is assigned to a frequency contained in said lower frequency band.

5. Antenna feed system as claimed in claim 4, in which said first waveguide section is connected via a coupling opening to a third rectangular waveguide section, and said radial circuit block being coupled to said third waveguide section.

6. Antenna feed system as claimed in claim 5, in which 3-dB directional couplers are designed as pairs of rectangular waveguides arranged in an L-shape with respect to their cross-sectional surfaces, the narrow side of the one waveguide being located on the wide side of the other of said waveguide or possesses a common wall with a part of this wide side.

7. Antenna feed system as claimed in claim 6, in which between the waveguides, coupling openings being provided which are common to both waveguides and which are located in the narrow waveguide side of the one waveguide and simultaneously in the edge zone of the wide waveguide side of the other of said waveguides.

8. Antenna feed system as claimed in claim 7, in which at least two adjacent rows of coupling openings are provided.

9. Antenna feed system as claimed in claim 8, in which said coupling openings are in the form of longitudinal holes.

10. Antenna feed system as claimed in claim 5, in which said 3-dB-directional couplers are designed as pairs of rectangular waveguides which are positioned one upon another on their wide sides.

11. Antenna feed system as claimed in claim 10, in which the rectangular waveguides of the 3-dB directional couplers possess a wide side designed as a common wall.

12. Antenna feed system as claimed in claim 1, in which said connection lines between said frequency filters and said 3-dB-directional couplers contain structurally symmetrical connection elements, which match one another in pairs, at the same point of the line.

13. Antenna feed system as claimed in claim 12, in which rectangular waveguide sections aligned obliquely to the longitudinal axis of the overall arrangement are provided as connection elements between said 3-dB directional coupler provided for the higher-frequency frequency band and the rectangular terminals, assigned to the latter, of the frequency filters.

14. Antenna feed system as claimed in claim 13, in which said 3-dB directional coupler provided for the lower frequency band is directly coupled to the coaxial accesses of the said frequency filters.

15. Antenna feed system as claimed in claim 10, in which said 3-dB directional coupler provided for the lower frequency band is aligned with its longitudinal axis at right angles to the axis of said polarization shunt, and the coaxial accesses of said frequency filters are connected structurally symmetrically to said 3-dB directional coupler provided for said lower frequency band in each case via a coaxial waveguide transition component and a waveguide connection component which is bent on both sides along said wide side.

16. Antenna feed system as claimed in claim 10, in which said 3-dB directional coupler provided for said upper frequency band is aligned with its longitudinal axis at right angles to the axis of said polarization shunt and is connected to two compensated, 45°-E-bend elements which are identical to one another, the 45°-E-bend elements being connected to compensated H-bend elements which are identical to one another and whose output axes are aligned parallel to the longitudinal axis of said orthomode transducer, and that between siad H-bend elements and said terminals, provided for said upper frequency band, of said frequency filters there are arranged further, oblique waveguide sections which are identical to one another.

17. Antenna feed system as claimed in claim 10, in which between the outputs, assigned to said upper frequency band, of said two frequency filters and the double access of the 3-dB directional coupler provided for the upper frequency band there are arranged two exactly structurally symmetrical 45°-twisted components of differing twisting direction, and two adjoining, oblique, straight line components which are structurally symmetrical to one another.

18. Antenna feed system as claimed in claim 3, in which said frequency filters each consist of a first waveguide section in which both frequency bands exist, a second waveguide section which adjoins said first waveguide section and in which only said upper frequency band exists, said two waveguide sections being designed as rectangular waveguides of differing cross-sectional dimensions, a radial circuit block having an extended inner conductor which blocks the upper frequency band is provided as output-coupling device, and the extended inner conductor leading through an opening in the wall of said first waveguide section at a distance of approximately $\lambda_H/4$ from the effective short-circuit plane of the cross-sectional jump occurring between said waveguide sections, where $\lambda_H$ is assigned to a frequency contained in said lower frequency band.

19. An antenna feed system for double polarization in two respective high-frequency bands of different frequency position, consisting of a polarization shunt (PW) with a connecting flange (1) in common on the antenna side for both frequency bands and two directional connections (SV) (see FIG. 4) respectively allocated to one polarization direction for a respective frequency shunt (FW) whose connection (=SV) in common for the two frequency bands is respectively connected to one of the directional connections (SV) of the polarization shunt (PW), consisting of a first three decibel directional coupler (RK2) (FIG. 2) for the lower frequency band whose double axis is respectively connected to one further connection of both frequency shunts (FW) allocated to the lower frequency band, and consisting of a three decibel directional coupler (RK1) for the upper frequency band which is respectively connected to one further connection of the frequency shunts (FW) allocated to the upper frequency band characterized in that the polarization shunt (PW) is constructed phase-symmetrical with respect to its pass-through paths, in that the directional connections (SV) of the polarization shunt are connected directly to the frequency shunts (FW) or respectively are connected via two 45° twisted pieces of different twisting direction which are precisely constructionally symmetrical, and in that the connecting lines between the frequency shunts (FW) and the three decibel directional couplers (RK1, RK2, 20, 20') for respectively two frequency bands of the same frequency range, said frequency bands existing in dual polarization directions, are constructed at the respectively same line location as phase-symmetrical line pairs with connection elements which coincide by pairs.

20. Antenna feed system for double polarization in two high-frequency bands of differing frequency position, comprising a polarization shunt with a connection in common on the antenna side for both frequency bands and two directional connections respectively allocated to one polarization direction for a respective frequency shunt, two frequency filters whose connection is common to said two frequency bands, is in each case connected to one of said directional connections of said polarization shunt, a first 3-dB directional coupler for the lower of said frequency bands whose double access is in each case connected to a further terminal, assigned to the lower frequency band of said two frequency filters, and further consisting of a 3-dB directional coupler for said upper frequency band which is connected to a further terminal, assigned to said upper frequency band of said frequency filters, said polarization shunt being constructed to be phase-symmetrical with respect to its transit paths, the directional terminals of said polarization shunt being connected directly or via two exactly structurally symmetrical 45° twisted components of differing twisting direction, to said frequency filters, said connection lines between said frequency filters and said 3-dB directional couplers in each case for said two frequency bands, occupying dual polarization directions of the same frequency range, are constructed as phase-symmetrical pairs of lines with connection elements which match one another in pairs at the same point of said line.

* * * * *